US009862002B2

(12) United States Patent
Ahmad et al.

(10) Patent No.: US 9,862,002 B2
(45) Date of Patent: Jan. 9, 2018

(54) PROCESS FOR PRODUCING A LAYER SYSTEM

(75) Inventors: Fathi Ahmad, Kaarst (DE); Christian Amann, Bottrop (DE); Björn Beckmann, Duisburg (DE); Björn Buchholz, Mülheim an der Ruhr (DE); Giuseppe Gaio, Bonn (DE); Thomas Hille, Dillenburg (DE); Eckart Schumann, Mülheim an der Ruhr (DE); Rostislav Teteruk, Mülheim an der Ruhr (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 786 days.

(21) Appl. No.: 14/354,573

(22) PCT Filed: Sep. 14, 2012

(86) PCT No.: PCT/EP2012/068048
§ 371 (c)(1),
(2), (4) Date: May 2, 2014

(87) PCT Pub. No.: WO2013/068159
PCT Pub. Date: May 16, 2013

(65) Prior Publication Data

US 2014/0295086 A1 Oct. 2, 2014

(30) Foreign Application Priority Data

Nov. 7, 2011 (EP) ..... 11188032

(51) Int. Cl.

| | |
|---|---|
| ***B05D 3/00*** | (2006.01) |
| ***C23C 30/00*** | (2006.01) |
| ***F01D 5/28*** | (2006.01) |
| ***F23R 3/00*** | (2006.01) |

(52) U.S. Cl.
CPC ..... *B05D 3/007* (2013.01); *C23C 30/00* (2013.01); *F01D 5/28* (2013.01); *F01D 5/288* (2013.01);
(Continued)

(58) Field of Classification Search
CPC B05D 3/007; C23C 30/00; F01D 5/28; F01D 5/288; F05D 2250/294;
(Continued)

(56) References Cited

U.S. PATENT DOCUMENTS 5,419,971 A * 5/1995 Skelly ..... C23C 4/02 428/161
6,074,706 A 6/2000 Conner
(Continued)

FOREIGN PATENT DOCUMENTS

EP 0486489 B1 11/1994
EP 0412397 B1 3/1998
(Continued)

*Primary Examiner* — Alexander M Weddle
(74) *Attorney, Agent, or Firm* — Beusse Wolter Sanks & Maire

(57) ABSTRACT

A process for producing a layer system is provided wherein the layer system has at least a substrate, a ceramic layer, which is applied to a surface structured in a targeted manner, in which process the intermediate layer, in particular the metallic layer, is applied in such a way that the recesses form during the coating. By introducing recesses into a surface, the stresses in the ceramic layer on the metallic substrate are reduced in such a manner that a longer lifespan for the ceramic layer is achieved.

15 Claims, 5 Drawing Sheets

(52) U.S. Cl.
CPC ..... *F23R 3/007* (2013.01); *F05D 2250/294* (2013.01); *F23M 2900/05003* (2013.01); *F23M 2900/05004* (2013.01); *F23R 2900/00018* (2013.01)

(58) Field of Classification Search
CPC ..... F23M 2900/05003; F23M 2900/05004; F23R 2900/00018; F23R 3/007
USPC ..... 427/331
See application file for complete search history.

(56) References Cited

U.S. PATENT DOCUMENTS

| | | | | |
|---|---|---|---|---|
| 2002/0172799 | A1* | 11/2002 | Subramanian | C23C 28/3215 428/116 |
| 2008/0085191 | A1 | 4/2008 | Liang | |
| 2009/0017260 | A1 | 1/2009 | Burns | |
| 2011/0097538 | A1* | 4/2011 | Bolcavage | F01D 5/288 428/137 |

FOREIGN PATENT DOCUMENTS

| | | | |
|---|---|---|---|
| EP | 0786017 | B1 | 3/1999 |
| EP | 1306454 | A1 | 5/2003 |
| EP | 1319729 | A1 | 6/2003 |
| EP | 1204776 | B1 | 6/2004 |
| EP | 2275645 | A2 | 1/2011 |
| WO | 9967435 | A1 | 12/1999 |
| WO | 0044949 | A1 | 8/2000 |
| WO | 2004043691 | A1 | 5/2004 |

* cited by examiner

FIG 9

| Material | Chemical composition in % | | | | | | | | | | | | |
|---|---|---|---|---|---|---|---|---|---|---|---|---|---|
| | C | Cr | Ni | Co | Mo | W | Ta | Nb | Al | Ti | B | Zr | Hf |
| Ni-based investment casting alloys | | | | | | | | | | | | | |
| GTD 222 | 0.10 | 22.5 | Rem. | 19.0 | | 2.0 | 1.0 | | 1.2 | 2.3 | 0.008 | | |
| IN 939 | 0.15 | 22.4 | Rem. | 19.0 | | 2.0 | 1.4 | 1.0 | 1.9 | 3.7 | 0.009 | 0.10 | |
| IN 6203 DS | 0.15 | 22.0 | Rem. | 19.0 | | 2.0 | 1.1 | 0.8 | 2.3 | 3.5 | 0.010 | 0.10 | 0.75 |
| Udimet 500 | 0.10 | 18.0 | Rem. | 18.5 | 4.0 | | | | 2.9 | 2.9 | 0.006 | 0.05 | |
| IN 738 LC | 0.10 | 16.0 | Rem. | 8.5 | 1.7 | 2.6 | 1.7 | 0.9 | 3.4 | 3.4 | 0.010 | 0.10 | |
| SC 16 | <0.01 | 16.0 | Rem. | | 3.0 | | 3.5 | | 3.5 | 3.5 | <0.005 | <0.008 | |
| Rene 80 | 0.17 | 14.0 | Rem. | 9.5 | 4.0 | 4.0 | | | 3.0 | 5.0 | 0.015 | 0.03 | |
| GTD 111 | 0.10 | 14.0 | Rem. | 9.5 | 1.5 | 3.8 | 2.8 | | 3.0 | 4.9 | 0.012 | 0.03 | |
| GTD 111 DS | | | | | | | | | | | | | |
| IN 792 CC | 0.08 | 12.5 | Rem. | 9.0 | 1.9 | 4.1 | 4.1 | | 3.4 | 3.8 | 0.015 | 0.02 | |
| IN 792 DS | 0.08 | 12.5 | Rem. | 9.0 | 1.9 | 4.1 | 4.1 | | 3.4 | 3.8 | 0.015 | 0.02 | 1.00 |
| MAR M C02 | 0.15 | 9.0 | Rem. | 10.0 | | 10.0 | 2.5 | | 5.5 | 1.5 | 0.015 | 0.05 | 1.50 |
| MAR M 247 LC DS | 0.07 | 8.1 | Rem. | 9.2 | 0.5 | 9.5 | 3.2 | | 5.6 | 0.7 | 0.015 | 0.02 | 1.40 |
| CMSX·2 | <.006 | 8.0 | Rem. | 4.6 | 0.6 | 8.0 | 6.0 | | 5.6 | 1.0 | <.003 | <.0075 | |
| CMSX·3 | <.006 | 8.0 | Rem. | 4.6 | 0.6 | 8.0 | 6.0 | | 5.6 | 1.0 | <.003 | <.0075 | 0.10 |
| CMSX·4 | | 6.0 | Rem. | 10.0 | 0.6 | 6.0 | 6.0 | | 5.6 | 1.0 | | Re=3.0 | 0.10 |
| CMSX·6 | <.015 | 10.0 | Rem. | 5.0 | 3.0 | <.10 | 2.0 | <.10 | 4.9 | 4.8 | <.003 | <.0075 | 0.10 |
| PWA 1480 SX | <.006 | 10.0 | Rem. | 5.0 | | 4.0 | 12.0 | | 5.0 | 1.5 | <.0075 | <.0075 | |
| PWA 1483 SX | 0.07 | 12.2 | Rem. | 9.0 | 1.9 | 3.8 | 5.0 | | 3.6 | 4.2 | 0.0001 | 0.002 | |
| Co-based investment casting alloys | | | | | | | | | | | | | |
| FSX 414 | 0.25 | 29.0 | 10 | Rem. | | 7.5 | | | | | 0.010 | | |
| X 45 | 0.25 | 25.0 | 10 | Rem. | | 8.0 | | | | | 0.010 | | |
| ECY 768 | 0.65 | 24.0 | 10 | 51.7 | | 7.5 | 4.0 | | 0.25 | 0.3 | 0.010 | 0.05 | |
| MAR·M·509 | 0.65 | 24.5 | 11 | Rem. | | 7.5 | 4 | | | 0.3 | 0.010 | 0.60 | |
| CM 247 | 0.07 | 8.3 | Rem. | 10.0 | 0.5 | 9.5 | 3.2 | | 5.5 | 0.7 | | | 1.5 |

PROCESS FOR PRODUCING A LAYER SYSTEM

CROSS REFERENCE TO RELATED APPLICATIONS

This application is the U.S. National Stage of International Application No. PCT/EP2012/068048 filed Sep. 14, 2012, and claims the benefit thereof. The International Application claims the benefit of European Application No. EP11188032 filed Nov. 7, 2011. All of the applications are incorporated by reference herein in their entirety.

FIELD OF INVENTION

The invention relates to a process for producing a layer system.

BACKGROUND OF INVENTION

High-temperature components such as gas turbine components are often provided with ceramic thermal barrier layers, but these can also spall under the most extreme operating conditions.

This is caused by the occurrence of stresses, which lead to instances of spalling of the ceramic thermal barrier layer.

A solution to date was to provide the thermal barrier layer retrospectively with recesses.

SUMMARY OF INVENTION

It is therefore an object of the invention to further improve the solution to the aforementioned problem.

The object is achieved by a production process as claimed in the independent claims.

The dependent claims list further advantageous measures which can be combined with one another, as desired, in order to achieve further advantages.

BRIEF DESCRIPTION OF THE DRAWINGS

FIG. 9 shows a list of superalloys.

The description and the figures represent exemplary embodiments of the invention.

DETAILED DESCRIPTION OF INVENTION

Figure 5:
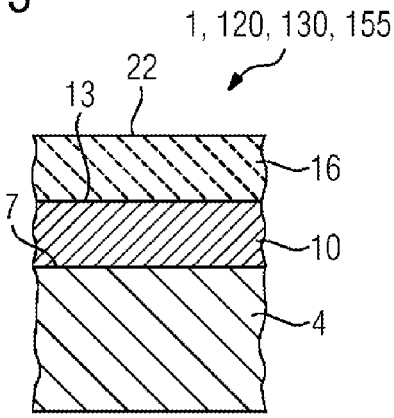

FIG. 5 shows a layer system 1, 120, 130, 155.

The layer system 1, 120, 130, 155 comprises a substrate 4, which in particular comprises a nickel-based or cobalt-based superalloy, in particular consists thereof, very particularly as per an alloy shown in FIG. 9.

An intermediate layer 10, in particular a metallic bonding layer 10, is optionally present on the surface 7 of the substrate 4, and a ceramic thermal barrier layer 16 is present in turn on the surface 13 of said intermediate layer.

There are also combinations of substrates 4 with an aluminized surface region, in which case the ceramic thermal barrier layer can be applied directly to the substrate.

The metallic bonding layer 10 preferably comprises an MCrAlX alloy.

Figure 1:
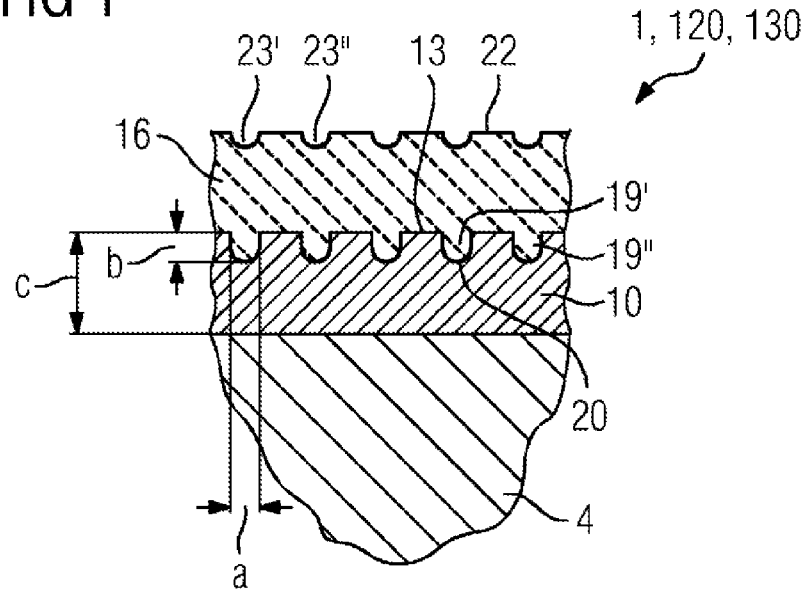
FIGS. 1-5 show exemplary embodiments of the invention.

According to the invention, recesses 19', 19", . . . are present in or are introduced into the surface 7 of the substrate 4 or in the surface 13 of the layer 10 (FIG. 1).

The recesses 19', 19", . . . have a certain depth b and a certain width a.

The width a of the recesses 19', 19", . . . is at least 10 μm, preferably 10 μm to 30 μm.

The depth b is at least 10%, preferably 10% to 30%, of the thickness of the underlying layer 10, very particularly 10 μm to 30 μm.

Figure 2:
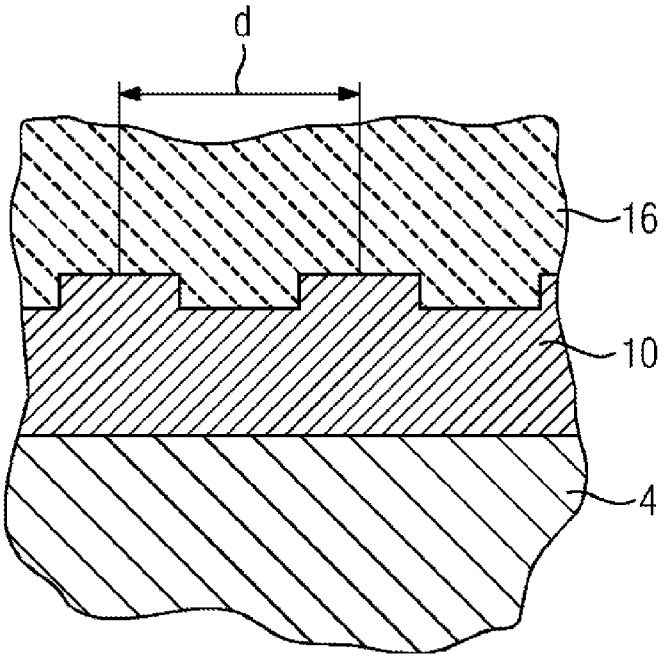

The distance d between the recesses 19', 19", . . . lying opposite one another is at least 100 μm, preferably between 100 μm and 300 μm (FIG. 2).

The parameters a, b, d can be varied depending on the operating conditions or locally (on the main blade or vane part 406 but not on the blade or vane platform 403) on the surface 7, 13.

Similarly, the recesses 19', 19" can be present on the surface 7, 13 of the component 1, 120, 130 only in a locally limited manner.

The recesses 19', 19", . . . can preferably have a round configuration at the base 20 (FIG. 1).

Figure 3:
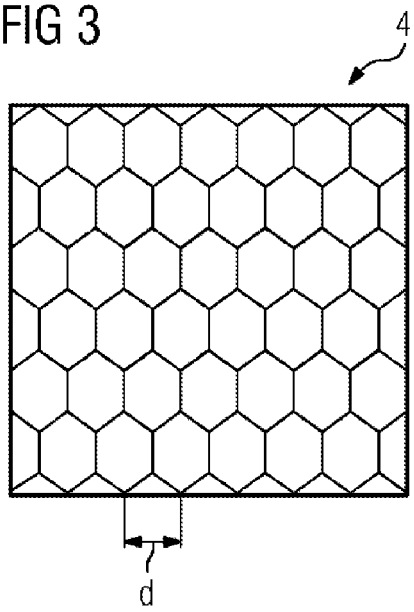
Figure 4:
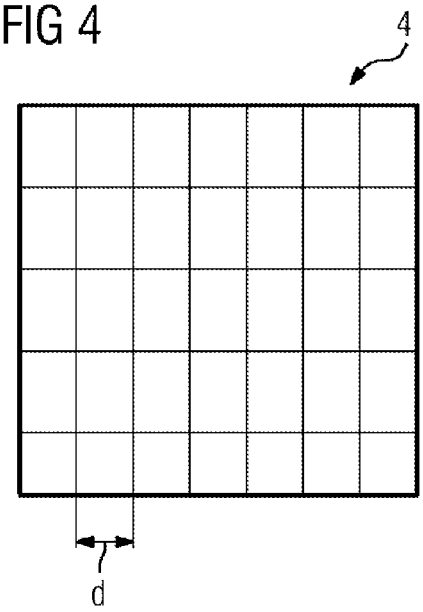

The recesses 19', 19", . . . can have a honeycomb structure (FIG. 3) or a mesh structure (FIG. 4).

FIG. 1 shows a cross section through such a surface structured in a targeted manner.

Depending on the size of the recesses 19', 19", . . . , the recess 19', 19" also continues into recesses 23', 23" at the surface 22 of the ceramic thermal barrier layer 16.

Stresses are reduced and the metallic bonding layer 10 and ceramic thermal barrier layer 16 (or layer 16 and substrate 4) are mechanically braced. It is much easier to machine the metallic surface of the layer 10 or of the substrate 4 than a ceramic surface.

Similarly, the coating 16 can be configured in such a way that the outermost surface 22 is smooth, i.e. the underlying recesses 23', 23" would not be identifiable on the surface 22.

The layers 10 are often applied by the application of material (e.g. powder) from a nozzle, in particular in a linear manner. By omitting a lane of coating when coating, or by targeted non-coating, no material is applied at that point and a recess 19', 19" is formed.

This is possible in particular in coating processes such as APS, VPS, LPPS, HVOF and cold gas spraying, in which powder is applied in tracks.

The structured surface 7, 13 is an integral part of a layer 10. It therefore does not constitute a honeycomb structure filled with a ceramic material.

Figure 6:
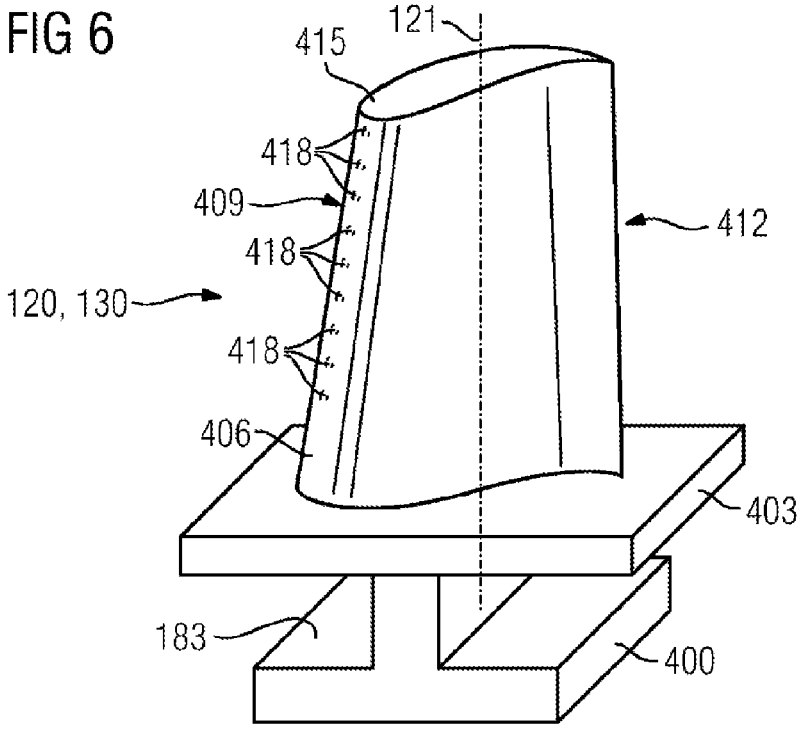
FIG. 6 shows a turbine blade or vane.

FIG. 6 shows, by way of example, a partial longitudinal section through a gas turbine 100.

In the interior, the gas turbine 100 has a rotor 103 with a shaft 101 which is mounted such that it can rotate about an axis of rotation 102 and is also referred to as the turbine rotor.

An intake housing 104, a compressor 105, a, for example, toroidal combustion chamber 110, in particular an annular combustion chamber, with a plurality of coaxially arranged burners 107, a turbine 108 and the exhaust-gas housing 109 follow one another along the rotor 103.

The annular combustion chamber 110 is in communication with a, for example, annular hot-gas passage 111, where, by way of example, four successive turbine stages 112 form the turbine 108.

Each turbine stage 112 is formed, for example, from two blade or vane rings. As seen in the direction of flow of a working medium 113, in the hot-gas passage 111 a row of guide vanes 115 is followed by a row 125 formed from rotor blades 120.

The guide vanes 130 are secured to an inner housing 138 of a stator 143, whereas the rotor blades 120 of a row 125 are fitted to the rotor 103 for example by a turbine disk 133.

A generator (not shown) is coupled to the rotor 103.

While the gas turbine 100 is operating, the compressor 105 sucks in air 135 through the intake housing 104 and compresses it. The compressed air provided at the turbine-side end of the compressor 105 is passed to the burners 107, where it is mixed with a fuel. The mix is then burnt in the combustion chamber 110, forming the working medium 113. From there, the working medium 113 flows along the hot-gas passage 111 past the guide vanes 130 and the rotor blades 120. The working medium 113 is expanded at the rotor blades 120, transferring its momentum, so that the rotor blades 120 drive the rotor 103 and the latter in turn drives the generator coupled to it.

While the gas turbine 100 is operating, the components which are exposed to the hot working medium 113 are subject to thermal stresses. The guide vanes 130 and rotor blades 120 of the first turbine stage 112, as seen in the direction of flow of the working medium 113, together with the heat shield elements which line the annular combustion chamber 110, are subject to the highest thermal stresses.

To be able to withstand the temperatures which prevail there, they may be cooled by a coolant.

Substrates of the components may likewise have a directional structure, i.e. they are in single-crystal form (SX structure) or have only longitudinally oriented grains (DS structure).

By way of example, iron-based, nickel-based or cobalt-based superalloys are used as material for the components, in particular for the turbine blade or vane 120, 130 and components of the combustion chamber 110.

Superalloys of this type are known, for example, from EP 1 204 776 B1, EP 1 306 454, EP 1 319 729 A1, WO 99/67435 or WO 00/44949.

The blades or vanes 120, 130 may likewise have coatings protecting against corrosion (MCrAlX; M is at least one element selected from the group consisting of iron (Fe), cobalt (Co), nickel (Ni), X is an active element and stands for yttrium (Y) and/or silicon, scandium (Sc) and/or at least one rare earth element, or hafnium). Alloys of this type are known from EP 0 486 489 B1, EP 0 786 017 B1, EP 0 412 397 B1 or EP 1 306 454 A1.

A thermal barrier layer, consisting for example of $ZrO_2$, $Y_2O_3$—$ZrO_2$, i.e. unstabilized, partially stabilized or fully stabilized by yttrium oxide and/or calcium oxide and/or magnesium oxide, may also be present on the MCrAlX.

Columnar grains are produced in the thermal barrier layer by suitable coating processes, such as for example electron beam physical vapor deposition (EB-PVD).

The guide vane 130 has a guide vane root (not shown here), which faces the inner housing 138 of the turbine 108, and a guide vane head which is at the opposite end from the guide vane root. The guide vane head faces the rotor 103 and is fixed to a securing ring 140 of the stator 143.

Figure 7:
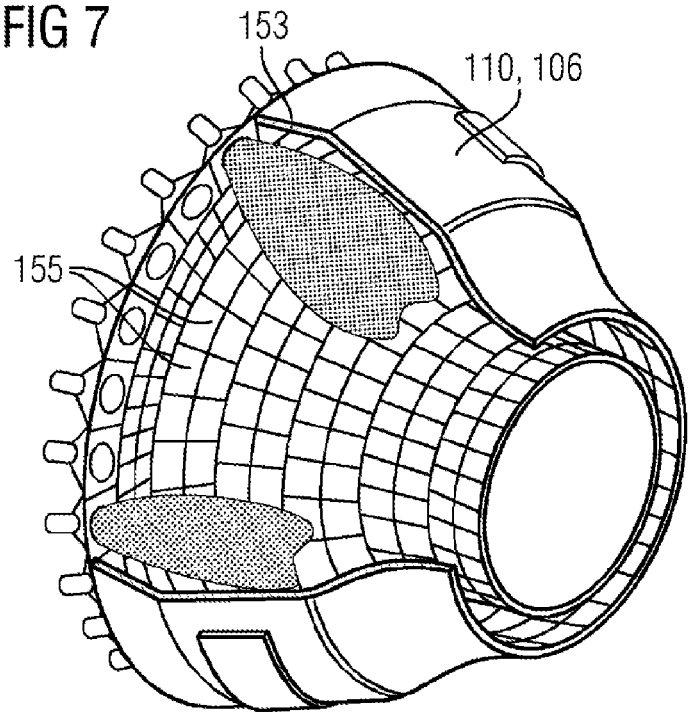
FIG. 7 shows a combustion chamber.

FIG. 7 shows a combustion chamber 110 of a gas turbine.

The combustion chamber 110 is configured, for example, as what is known as an annular combustion chamber, in which a multiplicity of burners 107, which generate flames 156 and are arranged circumferentially around an axis of rotation 102, open out into a common combustion chamber space 154. For this purpose, the combustion chamber 110 overall is of annular configuration positioned around the axis of rotation 102.

To achieve a relatively high efficiency, the combustion chamber 110 is designed for a relatively high temperature of the working medium M of approximately 1000° C. to 1600° C. To allow a relatively long service life even with these operating parameters, which are unfavorable for the materials, the combustion chamber wall 153 is provided, on its side which faces the working medium M, with an inner lining formed from heat shield elements 155.

On the working medium side, each heat shield element 155 made from an alloy is equipped with a particularly heat-resistant protective layer (MCrAlX layer and/or ceramic coating) or is made from material that is able to withstand high temperatures (solid ceramic bricks).

These protective layers may be similar to the turbine blades or vanes, i.e. for example MCrAlX: M is at least one element selected from the group consisting of iron (Fe), cobalt (Co), nickel (Ni), X is an active element and stands for yttrium (Y) and/or silicon and/or at least one rare earth element or hafnium (Hf). Alloys of this type are known from EP 0 486 489 B1, EP 0 786 017 B1, EP 0 412 397 B1 or EP 1 306 454 A1.

A for example ceramic thermal barrier layer, consisting for example of $ZrO_2$, $Y_2O_3$—$ZrO_2$, i.e. unstabilized, partially stabilized or fully stabilized by yttrium oxide and/or calcium oxide and/or magnesium oxide, may also be present on the MCrAlX.

Columnar grains are produced in the thermal barrier layer by suitable coating processes, such as for example electron beam physical vapor deposition (EB-PVD).

Other coating processes are conceivable, for example atmospheric plasma spraying (APS), LPPS, VPS or CVD. The thermal barrier layer may have grains that are porous and/or include micro-cracks or macro-cracks in order to improve the resistance to thermal shocks.

Refurbishment means that after they have been used, protective layers may have to be removed from heat shield elements 155 (e.g. by sand-blasting). Then, the corrosion and/or oxidation layers and products are removed. If appropriate, cracks in the heat shield element 155 are also repaired. This is followed by recoating of the heat shield elements 155, after which the heat shield elements 155 can be reused.

A cooling system may also be provided for the heat shield elements 155 and/or their holding elements, on account of the high temperatures in the interior of the combustion chamber 110. The heat shield elements 155 are then for example hollow and may also have cooling holes (not shown) which open out into the combustion chamber space 154.

Figure 8:
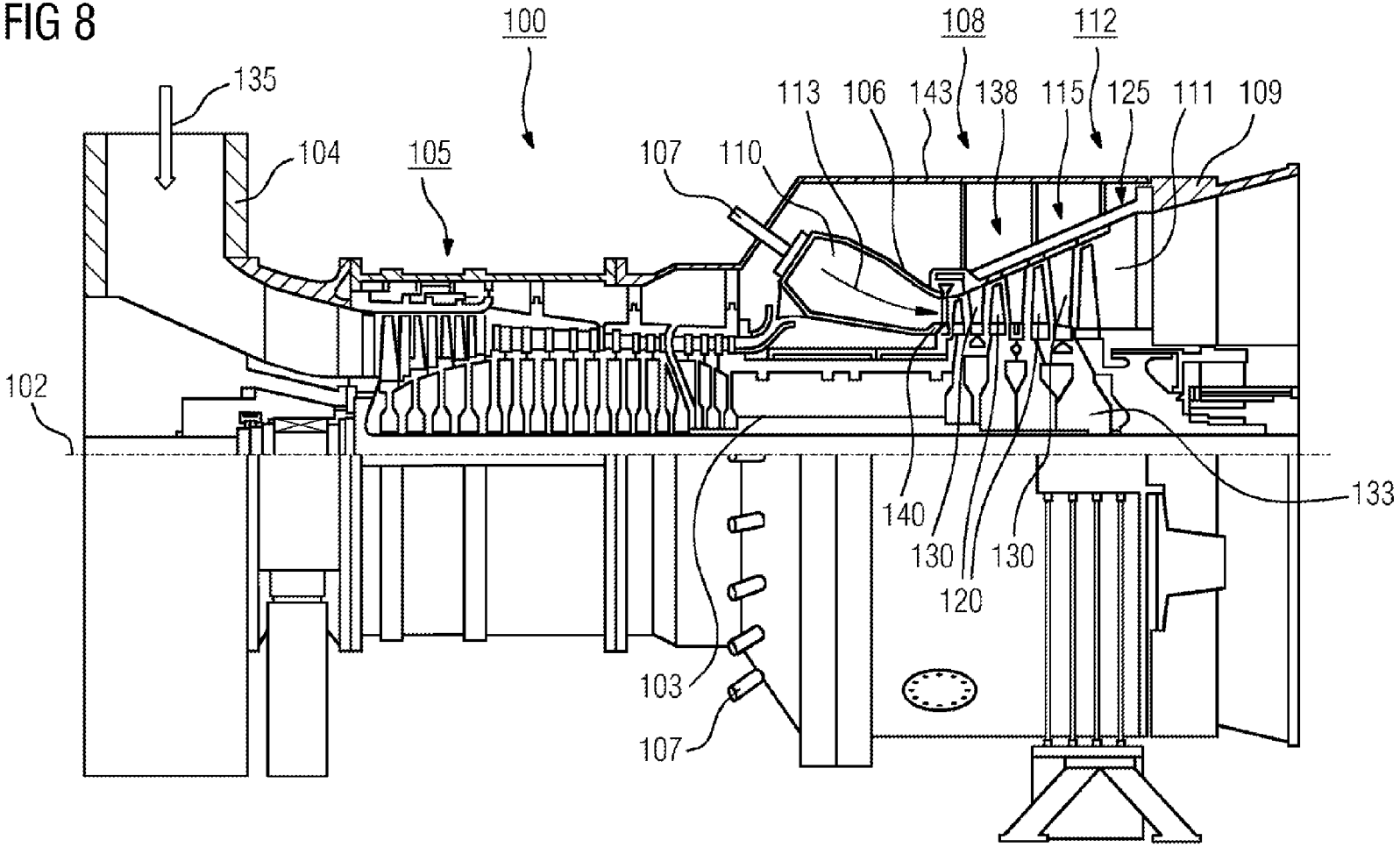
FIG. 8 shows a gas turbine.

FIG. 8 shows, by way of example, a partial longitudinal section through a gas turbine 100.

In the interior, the gas turbine 100 has a rotor 103 with a shaft 101 which is mounted such that it can rotate about an axis of rotation 102 and is also referred to as the turbine rotor.

An intake housing 104, a compressor 105, a, for example, toroidal combustion chamber 110, in particular an annular combustion chamber, with a plurality of coaxially arranged burners 107, a turbine 108 and the exhaust-gas housing 109 follow one another along the rotor 103.

The annular combustion chamber 110 is in communication with a, for example, annular hot-gas passage 111, where, by way of example, four successive turbine stages 112 form the turbine 108.

Each turbine stage 112 is formed, for example, from two blade or vane rings. As seen in the direction of flow of a working medium 113, in the hot-gas passage 111 a row of guide vanes 115 is followed by a row 125 formed from rotor blades 120.

The guide vanes 130 are secured to an inner housing 138 of a stator 143, whereas the rotor blades 120 of a row 125 are fitted to the rotor 103 for example by a turbine disk 133.

A generator (not shown) is coupled to the rotor 103.

While the gas turbine 100 is operating, the compressor 105 sucks in air 135 through the intake housing 104 and compresses it. The compressed air provided at the turbine-side end of the compressor 105 is passed to the burners 107, where it is mixed with a fuel. The mix is then burnt in the combustion chamber 110, forming the working medium 113. From there, the working medium 113 flows along the hot-gas passage 111 past the guide vanes 130 and the rotor blades 120. The working medium 113 is expanded at the rotor blades 120, transferring its momentum, so that the rotor blades 120 drive the rotor 103 and the latter in turn drives the generator coupled to it.

While the gas turbine 100 is operating, the components which are exposed to the hot working medium 113 are subject to thermal stresses. The guide vanes 130 and rotor blades 120 of the first turbine stage 112, as seen in the direction of flow of the working medium 113, together with the heat shield elements which line the annular combustion chamber 110, are subject to the highest thermal stresses.

To be able to withstand the temperatures which prevail there, they may be cooled by a coolant.

Substrates of the components may likewise have a directional structure, i.e. they are in single-crystal form (SX structure) or have only longitudinally oriented grains (DS structure).

By way of example, iron-based, nickel-based or cobalt-based superalloys are used as material for the components, in particular for the turbine blade or vane 120, 130 and components of the combustion chamber 110.

Superalloys of this type are known, for example, from EP 1 204 776 B1, EP 1 306 454, EP 1 319 729 A1, WO 99/67435 or WO 00/44949.

The blades or vanes 120, 130 may likewise have coatings protecting against corrosion (MCrAlX; M is at least one element selected from the group consisting of iron (Fe), cobalt (Co), nickel (Ni), X is an active element and stands for yttrium (Y) and/or silicon, scandium (Sc) and/or at least one rare earth element, or hafnium). Alloys of this type are known from EP 0 486 489 B1, EP 0 786 017 B1, EP 0 412 397 B1 or EP 1 306 454 A1.

A thermal barrier layer, consisting for example of $ZrO_2$, $Y_2O_3$—$ZrO_2$, i.e. unstabilized, partially stabilized or fully stabilized by yttrium oxide and/or calcium oxide and/or magnesium oxide, may also be present on the MCrAlX.

Columnar grains are produced in the thermal barrier layer by suitable coating processes, such as for example electron beam physical vapor deposition (EB-PVD).

The guide vane 130 has a guide vane root (not shown here), which faces the inner housing 138 of the turbine 108, and a guide vane head which is at the opposite end from the guide vane root. The guide vane head faces the rotor 103 and is fixed to a securing ring 140 of the stator 143.

The invention claimed is:

1. A process for producing a layer system, comprising:

applying a layer of metallic bonding material to cover a region of a substrate, and then applying additional metallic bonding material over less than all of the layer of metallic bonding material to form a surface comprising recesses, the recesses resulting from a depth of the additional metallic bonding material applied during the step of applying additional metallic bonding material; and applying a layer of a ceramic material over the surface, wherein ceramic material fills the recesses and mechanically braces the layer of ceramic material with the layer of metallic bonding material.

2. The process as claimed in claim 1, wherein the additional metallic bonding material is applied to form elongate recesses in the surface.

3. The process as claimed in claim 1, in which the recesses form a honeycomb structure.

4. The process as claimed in claim 1, in which the recesses form a mesh structure.

5. The process as claimed in claim 4, wherein the mesh structure comprises a square or rectangular mesh.

6. The process as claimed in claim 1, in which the recesses have a width of at least 10 μm.

7. The process as claimed in claim 6, wherein the recesses have a width of 10 μm to 30 μm.

8. The process as claimed in claim 1, in which the additional metallic bonding material is applied such that the recesses have a depth of at least 10% of a thickness of the underlying layer of metallic bonding material.

9. The process as claimed in claim 8, wherein the recesses have a depth of 10% to 30% of the layer thickness of the layer.

10. The process as claimed in claim 8, wherein the recesses have a depth of 10 μm to 30 μm.

11. The process as claimed in claim 1, in which the distance between recesses lying opposite one another is at least 100 μm.

12. The process as claimed in claim 11, wherein the distance between recesses lying opposite one another is between 100 μm and 300 μm.

13. The process as claimed in claim 1 wherein the layer of metallic bonding material comprises an MCrAlX alloy.

14. The process as claimed in claim 1, wherein a size of the recesses is controlled such that a surface of the layer of ceramic material comprises recesses corresponding to the recesses in the metallic bonding material.

15. The process as claimed in claim 1, wherein the step of applying additional metallic bonding material is accomplished by targeting spray of a powder from a nozzle onto the selected portions of the layer of metallic bonding material and not onto regions of the recesses.

* * * * *